US008213850B2

(12) United States Patent
Koakutsu et al.

(10) Patent No.: US 8,213,850 B2
(45) Date of Patent: Jul. 3, 2012

(54) CLEANING MEMBER, CARTRIDGE, AND IMAGE FORMING APPARATUS

(75) Inventors: Masafumi Koakutsu, Minamiashigara (JP); Yoshinori Kubo, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 450 days.

(21) Appl. No.: 12/411,774

(22) Filed: Mar. 26, 2009

(65) Prior Publication Data

US 2010/0074664 A1 Mar. 25, 2010

(30) Foreign Application Priority Data

Sep. 22, 2008 (JP) ..... 2008-242638

(51) Int. Cl.
*G03G 15/00* (2006.01)
*G03G 21/00* (2006.01)

(52) U.S. Cl. ..... 399/350; 399/71

(58) Field of Classification Search ..... 399/350
See application file for complete search history.

(56) References Cited

U.S. PATENT DOCUMENTS

| | | | | |
|---|---|---|---|---|
| 6,356,724 | B1 * | 3/2002 | Michlin | 399/106 |
| 2001/0028817 | A1 * | 10/2001 | Tamura et al. | 399/297 |
| 2004/0105710 | A1 * | 6/2004 | Shakuto et al. | 399/350 |
| 2005/0063734 | A1 * | 3/2005 | Saito et al. | 399/167 |
| 2005/0254868 | A1 * | 11/2005 | Naruse et al. | 399/350 |
| 2006/0160011 | A1 * | 7/2006 | Inoue et al. | 430/109.4 |
| 2008/0153028 | A1 * | 6/2008 | Farrugia | 430/137.14 |
| 2009/0111038 | A1 * | 4/2009 | Shin et al. | 430/48 |

FOREIGN PATENT DOCUMENTS

| | | |
|---|---|---|
| JP | A-3-158883 | 7/1991 |
| JP | A-6-67583 | 3/1994 |
| JP | A-2003-5580 | 1/2003 |
| JP | A-2003-5597 | 1/2003 |
| JP | A-2005-202026 | 7/2005 |
| JP | A-2005-301201 | 10/2005 |
| JP | A-2006-106017 | 4/2006 |
| JP | A-2006-267281 | 10/2006 |

OTHER PUBLICATIONS

Evidence—Specification sheet for strain gage KFG-02-120-C1-11L3M3R.*

Evidence—Specification sheet for strain gage KFG-02-120-C1-11L3M3R from Omega.com catalog printed Apr. 25, 2011, cited in USPGPUB 2001/0028817 dated Oct. 11, 2001 (evidence and PGPUB provided in Action dated May 12, 2011).*

Office Action issued in Japanese Patent Application No. 2008-242638, dated Jul. 13, 2010 (with English translation).

May 10, 2011 Office Action issued in Japanese Patent Application No. 2008-242638 (w/English-language Translation).

* cited by examiner

*Primary Examiner* — David Gray
*Assistant Examiner* — David Bolduc
(74) *Attorney, Agent, or Firm* — Oliff & Berridge, PLC

(57) ABSTRACT

A cleaning member including a member body that is brought into contact with a surface of a member to be cleaned; and a sensor that is fixed to a portion of the member body except a portion in contact with the member to be cleaned and is made of a metallic film.

8 Claims, 10 Drawing Sheets

CLEANING MEMBER, CARTRIDGE, AND IMAGE FORMING APPARATUS

CROSS-REFERENCE TO RELATED APPLICATIONS

This application is based on and claims priority under 35 USC 119 from Japanese Patent Application No. 2008-242638 filed on Sep. 22, 2008.

BACKGROUND

The present invention relates to a cleaning member, a cartridge, and an image forming apparatus.

SUMMARY

According to an aspect of the invention, there is provided a cleaning member including:

a member body that is brought into contact with a surface of a member to be cleaned; and a sensor that is fixed to a portion of the member body except a portion in contact with the member to be cleaned and is made of a metallic film.

BRIEF DESCRIPTION OF THE DRAWINGS

Exemplary embodiments of the present invention will be described in detail based on the following figures, wherein.

DETAILED DESCRIPTION

A description will be given below of exemplary embodiments according to the present invention.

Figure 1:
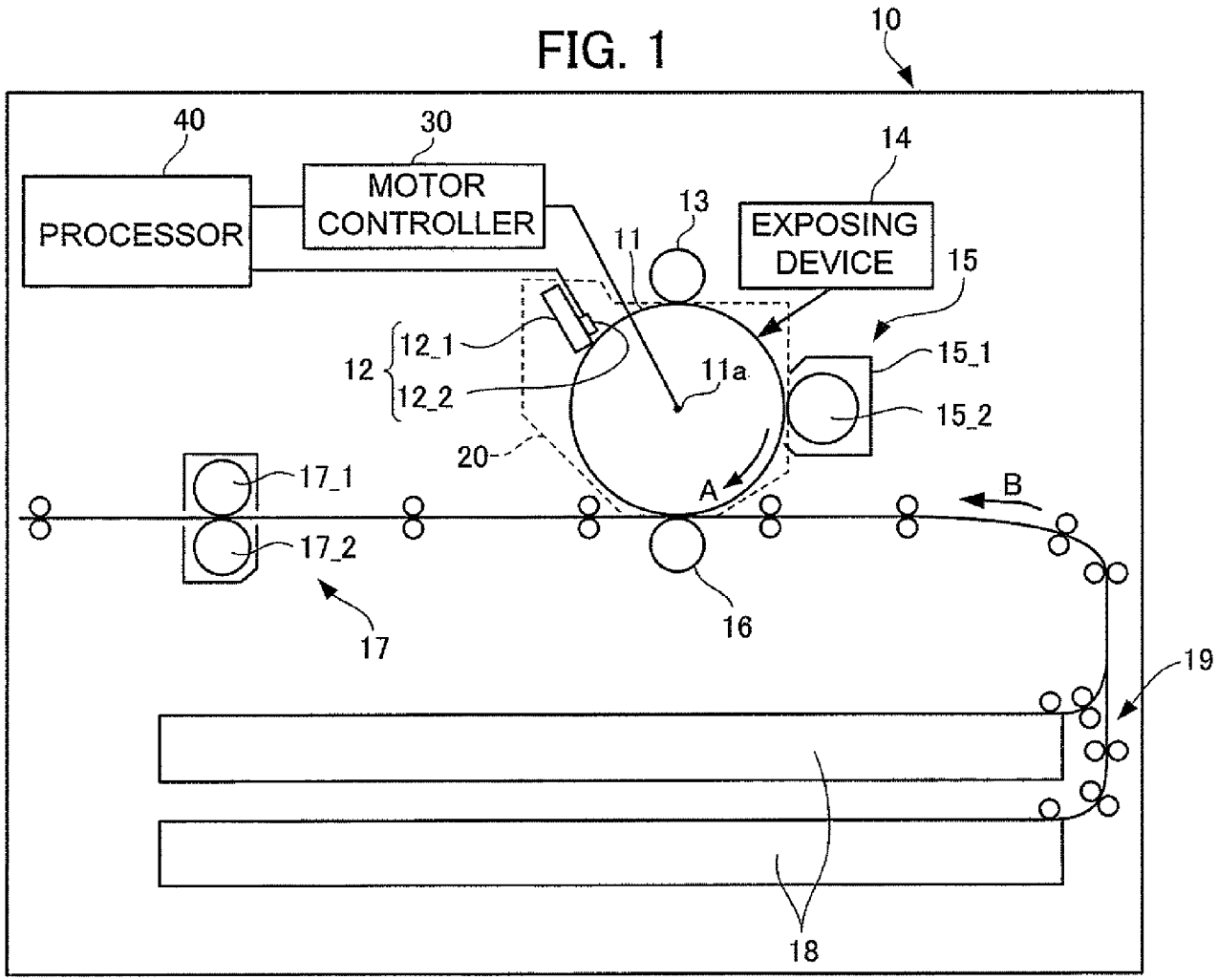
FIG. 1 is a diagram schematically illustrating the configuration of a printer in one exemplary embodiment of an image forming apparatus according to the present invention.

FIG. 1 is a diagram schematically illustrating the configuration of a printer in one exemplary embodiment of an image forming apparatus according to the present invention.

A printer 10 illustrated in FIG. 1 includes a photosensitive roll 11 exemplifying an image carrier that has an image formed thereon and carries the image thereon. The photosensitive roll 11 is rotated on a center axis 11*a* in a direction indicated by an arrow A. Its rotation allows the photosensitive roll 11 to make a circular motion at the surface thereof.

In addition, the printer 10 includes a cleaning member 12 in one exemplary embodiment of a cleaning member according to the present invention. The cleaning member 12 is provided with a blade 12_1 exemplifying a member body and a sensor 12_2 made of a thin metal. The blade 12_1 is a plate-like member made of a rubber material, which has an obverse directed slantwise upward and a reverse directed slantwise downward, as illustrated in FIG. 1. The sensor 12_2 is made by depositing a metallic film on the obverse of the blade 12_1. Here, the photosensitive roll 11 and the cleaning member 12 constitute a cartridge 20 in one exemplary embodiment of a cartridge according to the present invention.

Moreover, the printer 10 includes an electric charger 13 that applies an electric charge onto the photosensitive roll 11.

Additionally, the printer 10 includes an exposing device 14 that irradiates the photosensitive roll 11 applied with the electric charge by the electric charger 13 with an exposure light based on image data transmitted from the outside.

In addition, the printer 10 includes a developing device 15. The developing device 15 has a developer container 15_1 that contains a two-component developer incorporating a chemically produced toner including crystalline polyester and a magnetic carrier, and a developing roll 15_2 that holds the developer contained inside of the developer container 15_1 and is rotated in a state facing the surface of the photosensitive roll 11. Here, the electric charger 13, the exposing device 14, and the developing device 15 constitute one example of an image forming unit that forms an image on the image carrier.

Furthermore, the printer 10 is provided with a transfer roll 16 for transferring a development image onto a recording sheet and a fixing unit 17 that heats and pressurizes the development image transferred onto the recording sheet so as to fix it onto the recording sheet. The fixing unit 17 includes a fixing roll 17_1 having a heating mechanism and a pressure roll 17_2 disposed in a manner facing the fixing roll 17_1. Here, the transfer roll 16 and the fixing unit 17 constitute one example of a transferring/fixing unit that transfers and fixes the image formed on the image carrier onto the recording medium.

Additionally, the printer 10 is provided with recording sheet cassettes 18 that stack the recording sheets therein and a sheet feed unit 19 that draws the recording sheet from the recording sheet cassette 18 so as to feed it to a predetermined feed path.

In addition, the printer 10 includes a motor controller 30 and a processor 40.

In the printer 10, a motor (not illustrated) is rotated by the motor controller 30 that receives a command from the processor 40, so that the photosensitive roll 11 is rotated in the direction indicated by the arrow A. And then, the electric charge is applied onto the photosensitive roll 11 rotated in the direction indicated by the arrow A by the electric charger 13. Thereafter, the surface of the photosensitive roll 11 applied with the electric charge is irradiated with the exposure light produced by the exposing device 14 based on the image data transmitted from the outside, whereby an electrostatic latent image is formed on the photosensitive roll 11. Subsequently, the two-component developer incorporating the chemically produced toner including the crystalline polyester and the magnetic carrier, contained inside of the developer container 15_1 constituting the developing device 15, is held by the rotating developing roll 15_2 to be transported to a development position, at which the electrostatic latent image is developed, thereby forming a development image. Here, the chemically produced toner is generally easy to become globular, and further, is uniform in particle size, and therefore, is excellent in fluidity in comparison with other kinds of toners. The crystalline polyester has a property in which an endothermic peak appears in a sharp shape. As a consequence, the development image formed on the photosensitive roll 11 is fine in comparison with an image formed with kinds of toners other than the chemically produced toner, and therefore, can be fixed at a temperature lower than for an image formed with a toner not incorporating the crystalline polyester.

Moreover, the development image is transferred, by the transfer roll 16, onto the recording sheet drawn from the recording sheet cassette 18 and fed through the sheet fed unit 19 in a direction indicated by an arrow B in a transfer region defined between the photosensitive roll 11 and the transfer roll 16. Thereafter, the image is heated and pressurized to be fixed by the fixing unit 17, and thus, an image is formed on the recording sheet. The fixture is conducted at a low temperature, as described above.

Here, an unnecessary matter such as the toner that has not been transferred onto the recording sheet in the transfer region, sheet chips, or an electrically discharged product produced by the electric charging, adheres onto the photosensitive roll 11 passing the transfer region. Such an unnecessary matter is scraped off by the cleaning member 12, so that the photosensitive roll 11 is prepared for a subsequent image forming cycle.

Here, explanation will be made on the particulars of the chemically produced toner. The chemically produced toner is a generic name for a particle forming method independent of resin pulverization/sizing. The chemically produced toner is produced by emulsion polymerization coagulation in which a dispersion solution made of a resin particle obtained by emulsifying and polymerizing a polymeric monomer and a dispersion solution incorporating a colorant agent, a mold release agent, or a charge control agent, as required, are mixed each other, followed by coagulation and heating fusion, so as to obtain a toner; suspension polymerization in which a polymeric monomer for obtaining a binder resin, and a solution incorporating a colorant agent, a mold release agent, or a charge control agent, as required, are suspended in an aqueous solvent, followed by polymerization; dissolution suspension in which a binder resin, and a solution incorporating a colorant agent, a mold release agent, or a charge control agent, as required, are suspended in an aqueous solvent, followed by granulation; or the like. The chemically produced toner produced by the emulsification polymerization coagulation, the suspension polymerization, the dissolution suspension, or the like is more globular and uniform in particle size in comparison with a pulverized toner. Therefore, the development image formed on the photosensitive roll 11 with the chemically produced toner becomes finer than an image formed with a toner other than the chemically produced toner.

A GSD (Geometrical Standard Deviation) value indicating a particle size distribution of the chemically produced toner is 1 or more indicating a degree of particle size variations of the total toner particles (i.e., a particle size distribution) calculated from (16%-volume particle size of particle)/(84%-volume particle size of particle)$^{0.5}$ when the particles are arranged in increasing order of size. As the value approaches 1, the particle size is more monodisperse. The monodisperse generally signifies that the GSD value is about 1.1. The chemically produced toner has normally a GSD value of about 1.25 whereas a pulverized toner has a GSD value of about 1.7. In order to obtain a fine image, the GSD value of the toner is preferably decreased, that is, a particle size distribution is preferably narrowed. If the GSD value is 1.30 or more, fineness and granularity may become poor. In view of this, the GSD value is desirably 1.25 or less in actuality.

The sphericity of the toner indicates a spherical degree of a toner particle calculated from an expression of $100\times\pi\times(ML)^2/(4\times A)$, wherein ML designates a maximum length of a toner particle calculated by an image analyzer based on a two-dimensional projected image of a particle input by an optical microscope and A denotes a projected area of the toner particle. As the sphericity approaches 100, the particle is a more perfect sphere. A generally so-called perfect sphere has a sphericity of about 110. Practically, it is desirable that a toner particle has a sphericity of 130 or less. If the sphericity exceeds 130, a contact area between the photosensitive roll and the toner is increased, thereby showing a tendency to degrade transferring performance. More particularly, it is preferable that the sphericity is 120 or less.

The chemically produced toner including the crystalline polyester may be used in the present exemplary embodiment. The crystalline polyester has a property in which an endothermic peak appears in a sharp form, as described above. As a consequence, the chemically produced toner is fixed at a low temperature in comparison with a chemically produced toner not including any crystalline polyester.

Figure 2:
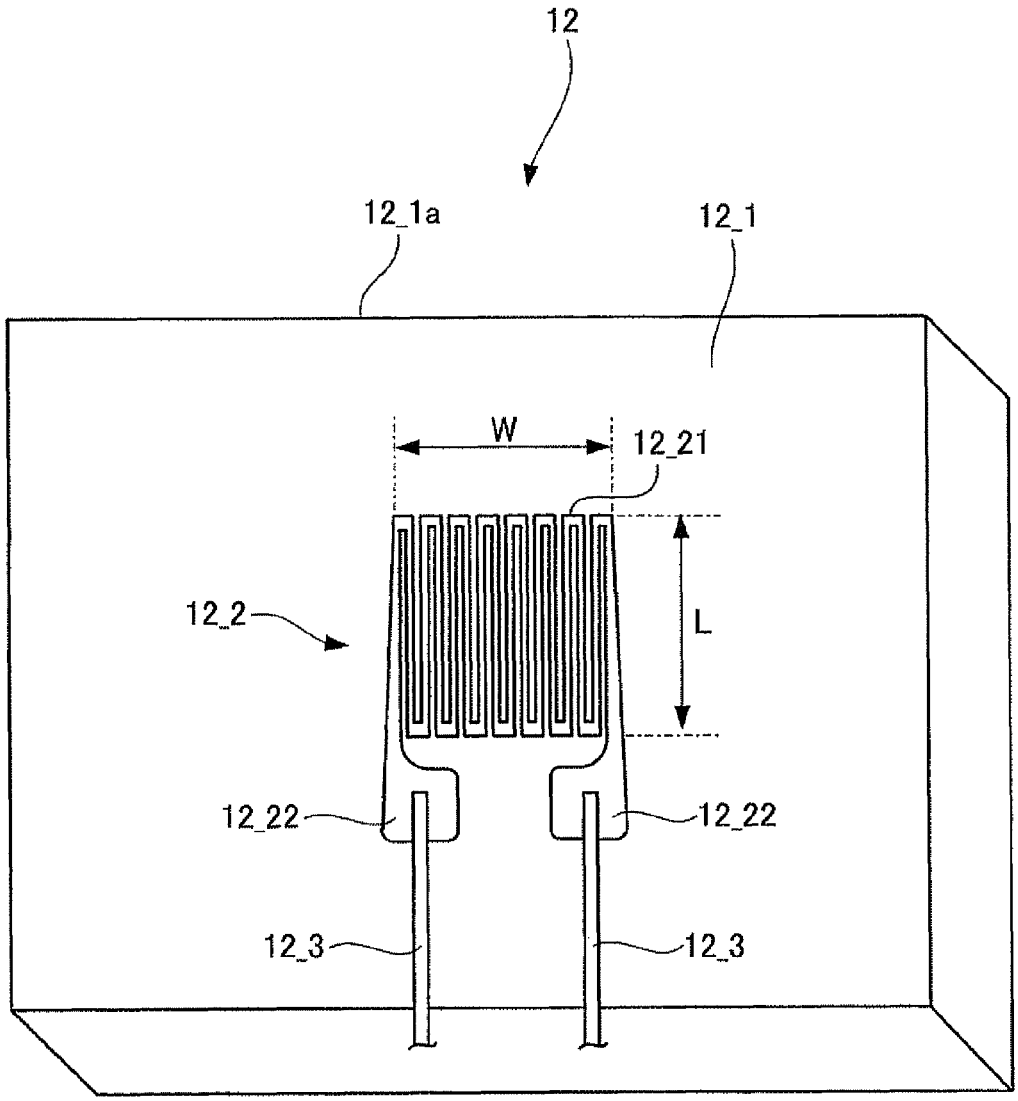
FIG. 2 is a diagram illustrating the configuration of a cleaning member.

FIG. 2 is a diagram illustrating the configuration of the cleaning member.

The cleaning member 12 illustrated in FIG. 2 includes the blade 12_1 and the sensor 12_2.

The blade 12_1 is brought at a tip 12_1*a*, illustrated in FIG. 2, into contact with the photosensitive roll 11. The sensor 12_2 is attached at a distance of 1 mm from the tip 12_1*a*.

The sensor 12_2 is constituted of a gage pattern 12_21 and gage tabs 12_22 connected to ends of the gage pattern 12_21, respectively. The sensor 12_2 is fabricated by depositing a metallic film onto the obverse of the blade 12_1. As a consequence, the sensor 12_2 can be readily fabricated with little cumbersome work in comparison with the case where a metallic film is stuck onto the blade 12_1 via an adhesive agent. In addition, the metallic film deposited onto the obverse of the blade 12_1 is hardly peeled off with high durability.

The gage pattern 12_21 consists of a narrow pattern in a continuous fanfold manner. When the blade 12_1 is strained to be expanded or contracted at the surface thereof, the gage pattern 12_21 also is expanded or contracted following the expansion or contraction of the blade 12_1 without inhibiting the deformation of the blade 12_1. Consequently, when the pattern is elongated, a decrease in cross-sectional area or density increases a resistance: in contrast, when the pattern shrinks, the resistance is decreased.

The gage tabs 12_22 consist of a pattern wider than the gage pattern 12_21 such that connection with a gage lead 12_3 does not adversely influence on the expansion or contraction of the gage pattern 12_21.

The length (i.e., a gage length) L of the sensor 12_2 may range from 0.2 mm to 5 mm. Additionally, the width (i.e., a gage width) W of the sensor 12_2 may range from 0.5 mm to 5 mm. If the length and width fall short of the ranges, machining with high accuracy is needed, and further, a noise with respect to a signal becomes large. In contrast, if the length and width fall out of the ranges, a ratio of an area of the sensor with respect to the blade 12_1 becomes greater, thereby inducing a possibility of degraded followability to the deformation of the blade 12_1.

The blade 12_1 is deformed in a direction of the gage length L of the sensor 12_2. As a consequence, a configuration having the gage length L greater than the gage width W is more suitable for detecting a change in resistance of the sensor 12_2.

A material of the metallic film is selected from a group consisting of aluminum, zinc, nickel, titanium, vanadium, chromium, tantalum, iron, manganese, silicon, or alloy, oxide, nitride, and silicate thereof.

When the photosensitive roll 11 illustrated in FIG. 1 is rotated, the tip 12_1*a* of the blade 12_1 in contact with the surface of the photosensitive roll 11 is caught up frontward in FIG. 2, so that the blade 12_1 is deformed in a direction in which the obverse is contracted. And then, the cross-sectional area or density of the gage pattern 12_21 per se becomes great, and as a result, the resistance of the sensor 12_2 becomes small. As a consequence, monitoring the resistance of the sensor 12_2 signifies monitoring the behavior of the blade 12_1.

The resistance of the sensor 12_2 is monitored by the processor 40 illustrated in FIG. 1. Explanation will be made below in reference to FIG. 3.

Figure 3:
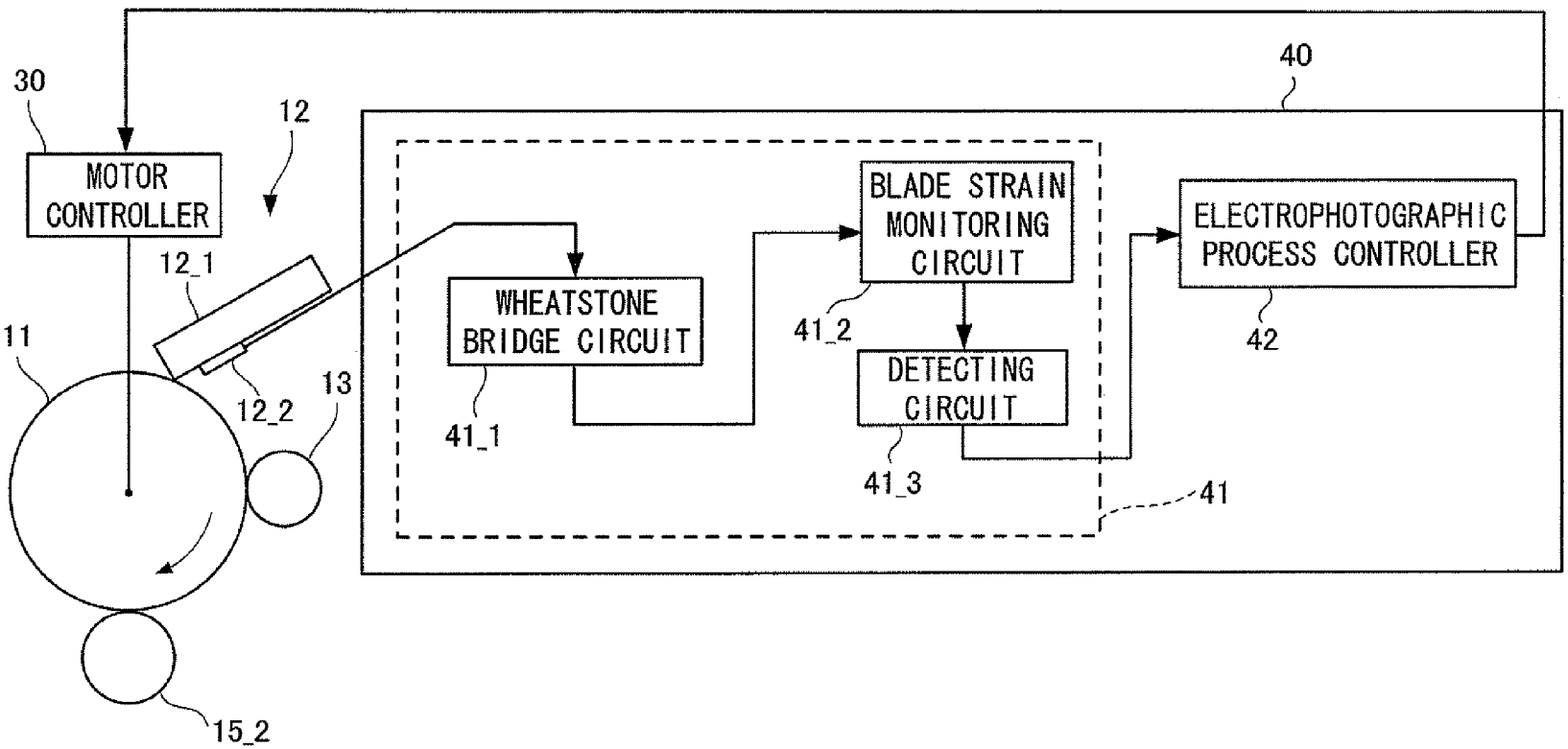
FIG. 3 is a diagram illustrating the configuration of a processor illustrated in FIG. 1.

FIG. 3 is a diagram illustrating the configuration of the processor illustrated in FIG. 1.

Here, FIG. 3 also illustrates the photosensitive roll 11, the cleaning member 12, the electric charger 13, the developing roll 15_2, and the motor controller 30 illustrated in FIG. 1.

The processor 40 illustrated in FIG. 3 includes a strain gage 41 and an electrophotographic process controller 42.

The strain gage 41 is provided with a Wheatstone bridge circuit 41_1, a blade strain monitoring circuit 41_2, and a detecting circuit 41_3. The configuration of the Wheatstone bridge circuit 41_1 will be first described in reference to FIG. 4.

Figure 4:
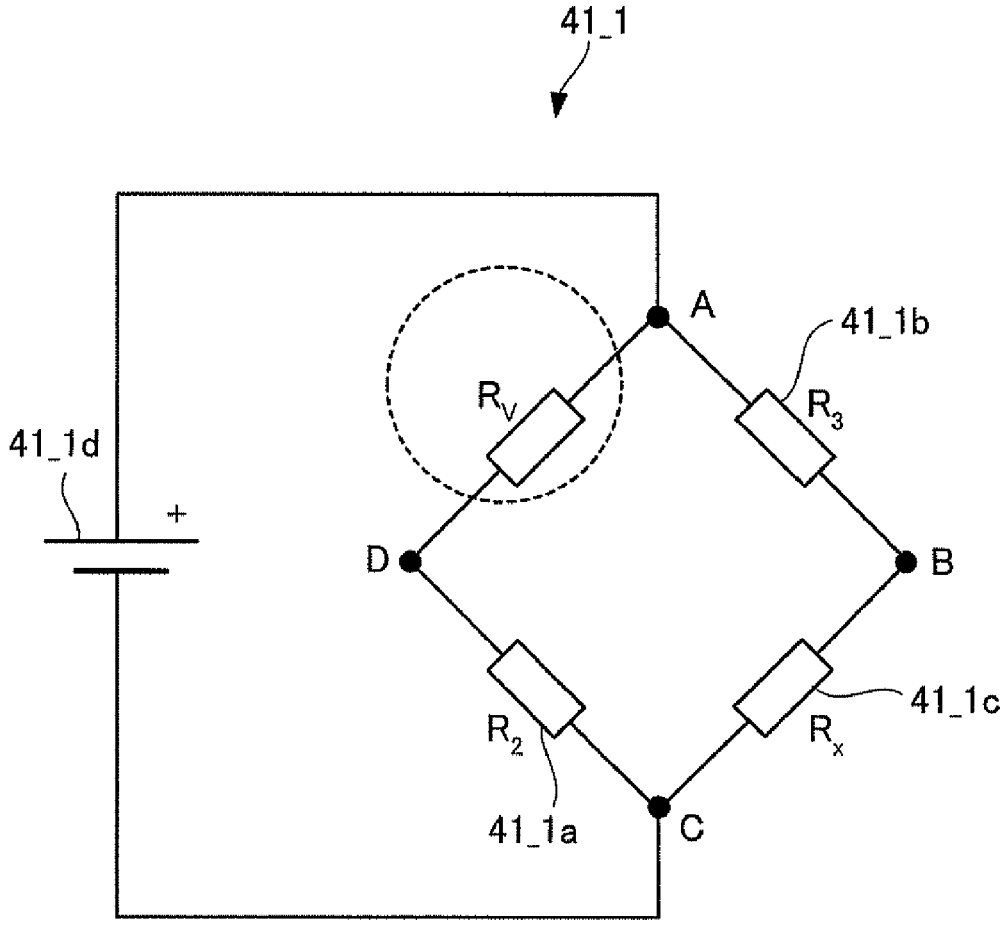
FIG. 4 is a diagram illustrating the configuration of a Wheatstone bridge circuit illustrated in FIG. 3.

FIG. 4 is a diagram illustrating the configuration of the Wheatstone bridge circuit illustrated in FIG. 3.

Resistance elements 41_1*a*, 41_1*b*, and 41_1*c* constituting the Wheatstone bridge circuit 41_1 have resistances $R_2$, $R_3$, and $R_x$, respectively. Here, a resistance $R_v$ illustrated in FIG. 4 is a resistance of the sensor 12_2. When the blade 12_1 is caught up at the tip there of to be deformed in the direction in which the obverse is contracted, the resistance $R_v$ becomes small. A DC power source 41_1*d* is connected between nodes A and C in the Wheatstone bridge circuit 41_1. In addition, the blade strain monitoring circuit 41_2 illustrated in FIG. 3 is connected between nodes B and D.

Here, a voltage between the nodes B and D becomes zero when an equation (1) below is established.

$$R_v/R_2=R_3/R_x \quad (1)$$

In the Wheatstone bridge circuit 41_1, the resistance $R_x$ is set such that the equation (1) is established in a state in which the blade 12_1 is not deformed. As a consequence, a voltage generated between the nodes B and D indicates the deformation amount of the blade 12_1, wherein the sign of the voltage designates a deformation direction (expansion or contraction).

Returning to FIG. 3, the explanation will be continued below. The electrophotographic process controller 42 rotates the motor (not illustrated) via the motor controller 30, thereby driving the photosensitive roll 11. Then, the blade 12_1 scrapes off an unnecessary material from the surface of the photosensitive roll 11. Here, when the unnecessary material that has not been scraped off by the blade 12_1 and remains, is accumulated between the surface of the photosensitive roll 11 and the tip of the blade 12_1, the tip of the blade 12_1 is caught up to be deformed. And then, a voltage according to the deformation is generated between the nodes B and D in the Wheatstone bridge circuit 41_1. The voltage is monitored by the blade strain monitoring circuit 41_2, and then, the monitored voltage is output to the detecting circuit 41_3 as an output. Here, the sign of the output is minus in a direction in which the surface of the blade 12_1 having the sensor 12_2 mounted thereon is contracted.

The detecting circuit 41_3 detects whether or not the output is lower than a predetermined threshold, that is, whether or not the tip of the blade 12_1 is largely caught up. As a result of the detection, if the output is lower than the threshold, the detecting circuit 41_3 outputs a trigger signal indicating that the output is lower than the threshold to the electrophotographic process controller 42. Upon receipt of the trigger signal, the electrophotographic process controller 42 stops the rotation of the motor via the motor controller 30. In this manner, the photosensitive roll 11 is stopped. And then, the unnecessary material accumulated between the surface of the photosensitive roll 11 and the tip of the blade 12_1 temporarily crumbles. As a consequence, the force to catch up the tip of the blade 12_1 is released, so that the strain of the blade 12_1 is restored.

As described above, the chemically produced toner may be used in the printer 10 in the present exemplary embodiment. The chemically produced toner is excellent in fluidity, and therefore, a fine image can be formed: whereas the amount of toner remaining at the tip of the blade 12_1 is large, whereby the blade 12_1 is liable to be deformed. As for this point, a description will be given below in reference to part (a) and (b) of FIG. 5, and part (a) and (b) of FIG. 6.

Figure 5:
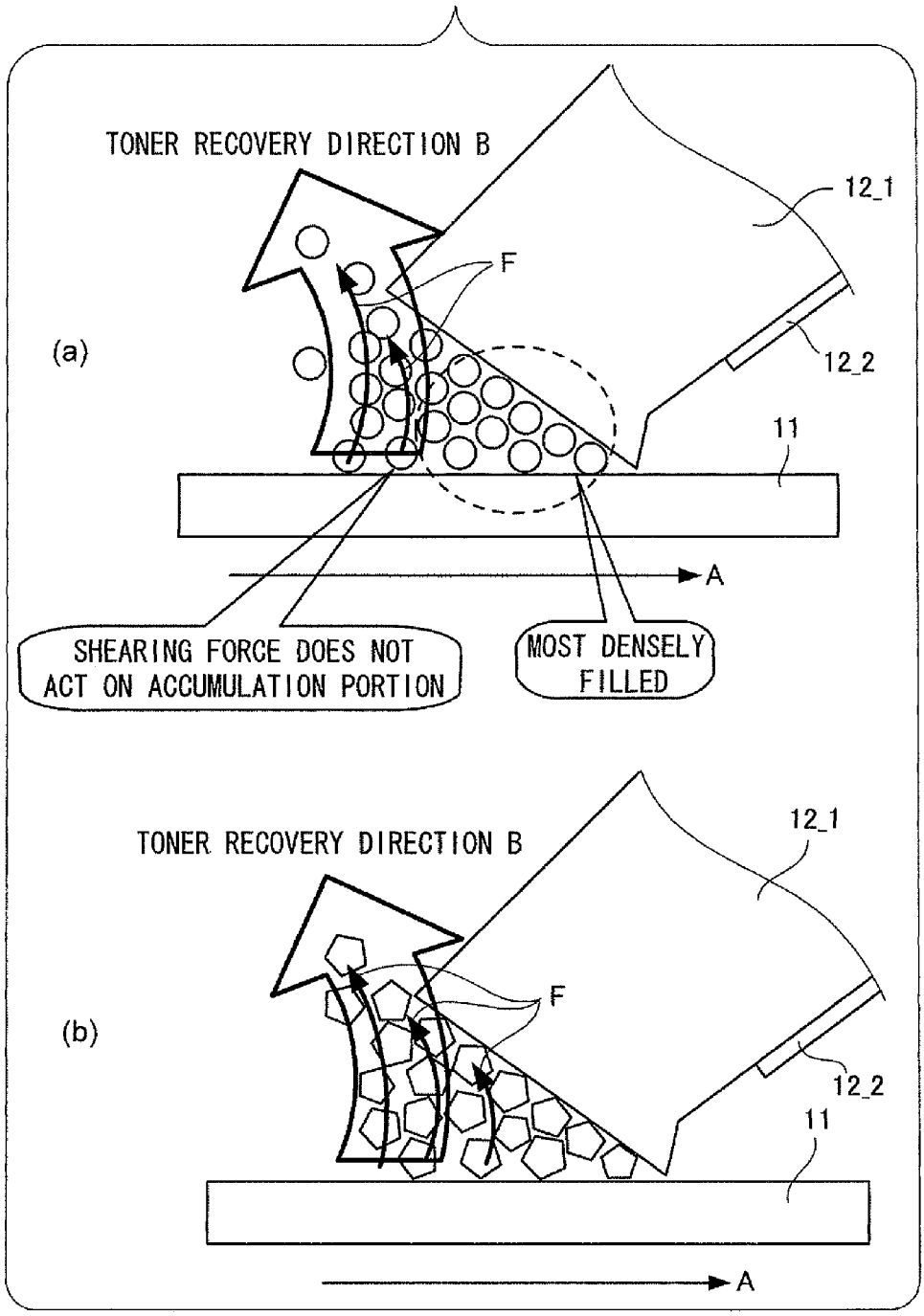
FIG. 5 is a diagram illustrating a state of force acting on an accumulation portion of a toner accumulated between a surface of a photosensitive roll and a tip of a blade.

Part (a) and (b) of FIG. 5 are diagrams illustrating states of force acting on an accumulation portion of the toner accumulated between the surface of the photosensitive roll and the tip of the blade.

Part (a) of FIG. 5 illustrates a state in which the force acts on the accumulation portion of a toner in a case where a spherical toner having a uniform particle size is used. Incidentally, although the surface of the photosensitive roll 11 is originally curved, it is schematically illustrated as a flat surface.

As illustrated in Part (a) of FIG. 5, the tip (i.e., an edge) of the blade 12_1 is brought into contact with the surface of the photosensitive roll 11 that is moved in a direction indicated by an arrow A, so that the spherical toner having a uniform particle size is recovered in a direction indicated by an arrow B. Particles of the toner are closest to each other (i.e., are most densely filled) at the accumulation portion surrounded by a dot line. In this state, a toner recovering force (i.e., a shearing force) F does not act on the accumulation portion. In other words, the toner is liable to be most densely filled since the particle size is uniform. In addition, since the toner is spherical, a resistance due to a contact between the particles is small. As a consequence, the shearing force F does not act on the accumulation portion due to the remaining of the toner in recovering the toner. Therefore, the blade 12_1 is largely strained in comparison with a case where an amorphous toner having an irregular particle size is used, as described below.

Part (b) of FIG. 5 illustrates a state in which the force acts on the accumulation portion of a toner in the case where an amorphous toner having an irregular particle size is used.

As illustrated in part (b) of FIG. 5, since the toner has the irregular particle size, it is not liable to be most densely filled. In addition, since the toner has the amorphous shape, the particles are caught by each other. As a consequence, the shearing force F acts on the accumulation portion due to the remaining of the toner in recovering the toner in a direction indicated by an arrow B. Therefore, the blade 12_1 is slightly strained in comparison with the case where the spherical toner having the uniform particle size is used.

Figure 6:
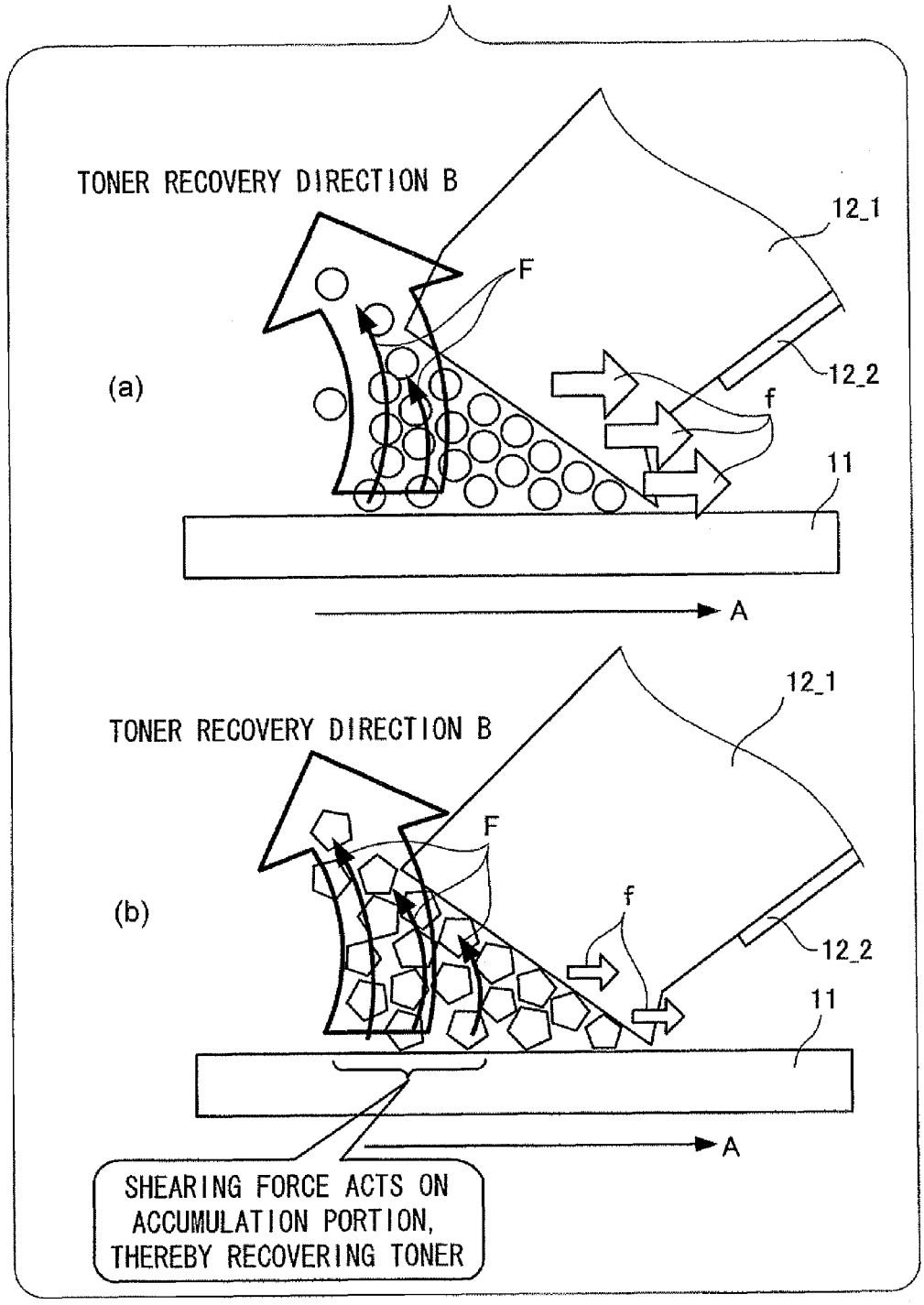
FIG. 6 is a diagram illustrating a state in which the blade illustrated in FIG. 5 is strained.

Part (a) and (b) of FIG. 6 are diagrams illustrating states in which the blades illustrated in part (a) and (b) of FIG. 5 are strained.

Part (a) of FIG. 6 illustrates a state in which the blade 12_1 illustrated in part (a) of FIG. 5 is strained. As described above, in the case where the spherical toner having the uniform particle size is used, the toner is liable to be most densely filled in the accumulation portion, at which the toner remains, at the tip of the blade 12_1, so that the toner behaves as a solid layer. As a consequence, the shearing force F does not act on the accumulation portion, and therefore, the amount of toner remaining at the tip of the blade 12_1 is large. Thus, force f acting at the tip of the blade 12_1 is large, and as a result, the blade 12_1 is largely deformed.

Here, the amount of toner remaining at the tip of the blade 12_1 greatly depends upon the ratio between an image region (a region in which a toner image is formed) and a non-image region (a region in which no toner image is formed) on a recording sheet. The printer 10 in the present exemplary embodiment can cope with a recording sheet of up to A3 size. In a case where the recording sheet of A3 size is fed in a longitudinal direction of the sheet and the ratio of the image region is greater than that of the non-image region, the amount of toner remaining at the tip of the blade 12_1 is largest, and therefore, the strain of the blade 12_1 becomes conspicuous. Then, a contact force of the blade 12_1 with the photosensitive roll 11 becomes large, thereby increasing abrasion of the photosensitive roll 11.

In contrast, part (b) of FIG. 6 illustrates a state in which the blade 12_1 illustrated in part (b) of FIG. 5 is strained. As described above, the shearing force F acts on the accumulation portion in the case where the amorphous toner having the irregular particle size is used, thereby recovering the toner. As a consequence, the amount of toner remaining at the tip of the blade 12_1 is small, so that the force f acting at the tip of the blade 12_1 is small, and as a result, the blade 12_1 is slightly deformed.

In the present exemplary embodiment, the spherical chemically produced toner having the uniform particle size may be used. Therefore, the amount of toner remaining at the tip of the blade 12_1 is large. However, in the case where the blade 12_1 is deformed, so that the output is lower than the threshold, the photosensitive roll 11 is controlled to be stopped, as described above. Therefore, the strain of the blade 12_1 is restored, as described below.

Next, explanation will be made on the states of the cleaning member 12 in both cases where the photosensitive roll 11 is stopped and driven.

Figure 7:
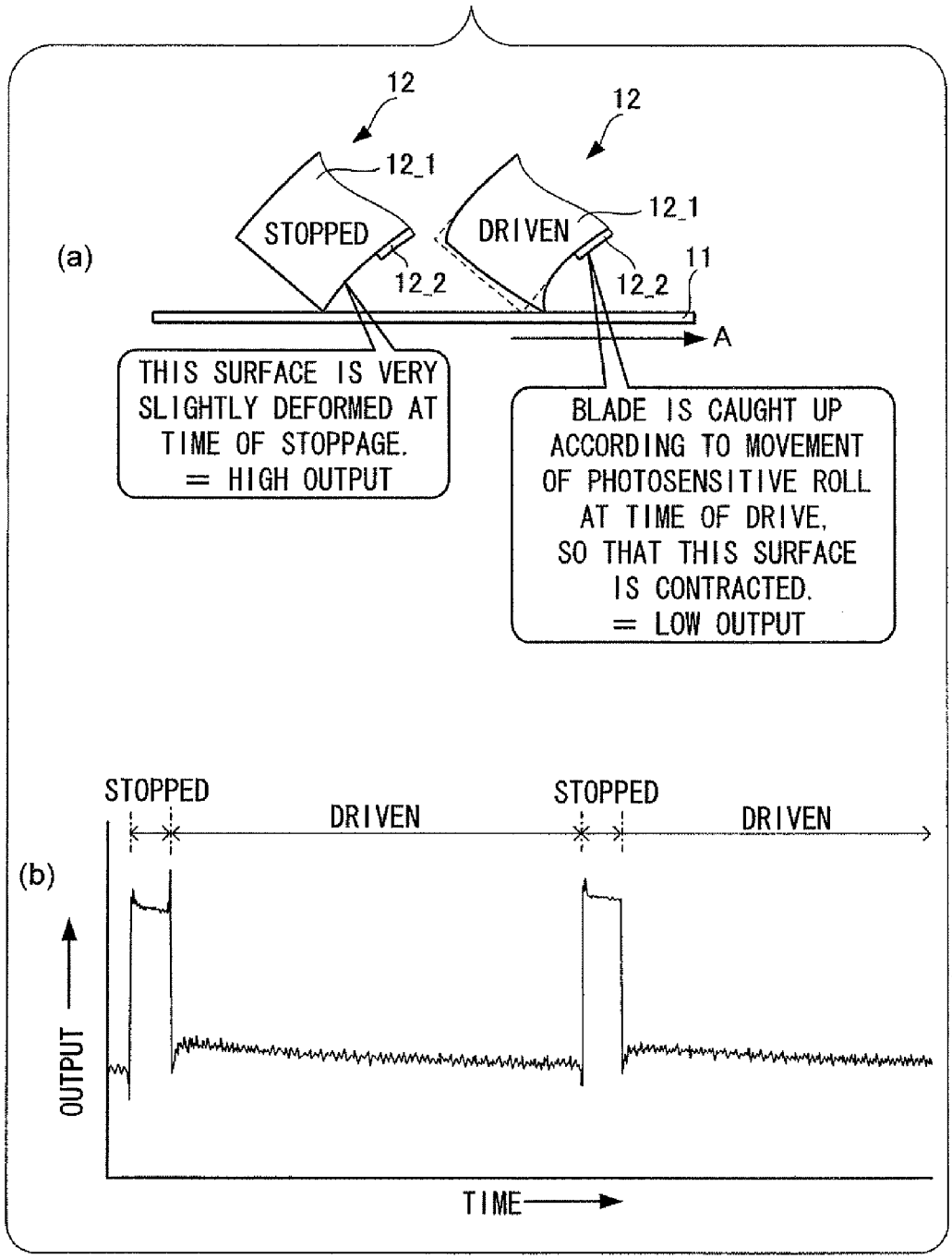
FIG. 7 is a diagram illustrating a state of the cleaning member in both cases where the photosensitive roll is stopped and driven.

Part (a) and (b) of FIG. 7 are diagrams illustrating states of the cleaning member in both of cases where the photosensitive roll is stopped and driven.

Part (a) of FIG. 7 illustrates, in arrangement, both states of the cleaning member 12 when the photosensitive roll 11 is stopped and when the photosensitive roll 11 is driven. Part (b) of FIG. 7 illustrates an output from the blade strain monitoring circuit 41_2 illustrated in FIG. 3 in a case where the stoppage and drive of the photosensitive roll 11 are repeated.

Since the toner remaining at the tip of the blade 12_1 constituting the cleaning member 12 crumbles in the case where the photosensitive roll 11 is stopped, the blade 12_1 is slightly deformed, as illustrated on the left of part (a) of FIG. 7. As a consequence, a resistance of the sensor 12_2 deposited onto the obverse of the blade 12_1 approximates a resistance at the time of no deformation. Therefore, the voltage between the nodes B and D in the Wheatstone bridge circuit 41_1 illustrated in FIG. 4 approximates zero. And then, outputs corresponding to the value approximate to zero are shown on the left and at the center of part (b) of FIG. 7.

In contrast, the tip of the blade 12_1 is caught up according to the movement of the photosensitive roll 11 in the direction indicated by the arrow A in the case where the photosensitive roll 11 is driven, so that the blade 12_1 is largely deformed at the obverse thereof, as illustrated on the right of part (a) of FIG. 7. And then, the sensor 12_2 shows a resistance smaller by the deformation than the resistance at the time of the stoppage. Therefore, a minus voltage indicating a deformation amount of the blade 12_1 is generated between the nodes B and D in the Wheatstone bridge circuit 41_1. Minus outputs corresponding to the minus voltage are shown in regions except the left and the center of part (b) of FIG. 7.

As obvious from part (b) of FIG. 7, the toner gradually remains at the tip of the blade 12_1 when the photosensitive roll 11 is continued to be driven, and therefore, the deformation amount (i.e., the strain) of the blade 12_1 becomes larger. As a consequence, the output is decreased. Here, when the photosensitive roll 11 is stopped, the toner remaining at the tip of the blade 12_1 crumbles. Therefore, the strain of the blade 12_is restored more than that before the stoppage upon restart of the drive of the photosensitive roll 11. This is confirmed from that the output illustrated in part (b) of FIG. 7 is greater (i.e., a value approximate to a plus value) immediately after the drive of the photosensitive roll 11 than immediately before the stoppage. Thereafter, when the photosensitive roll 11 is continued to be driven, the output is decreased again from the restored large value. In the present exemplary embodiment, in the case where the output is lower than the threshold (i.e., the strain becomes larger), the photosensitive roll 11 is temporarily stopped to restore the strain. Explanation will be made below in reference to FIG. 8.

Figure 8:
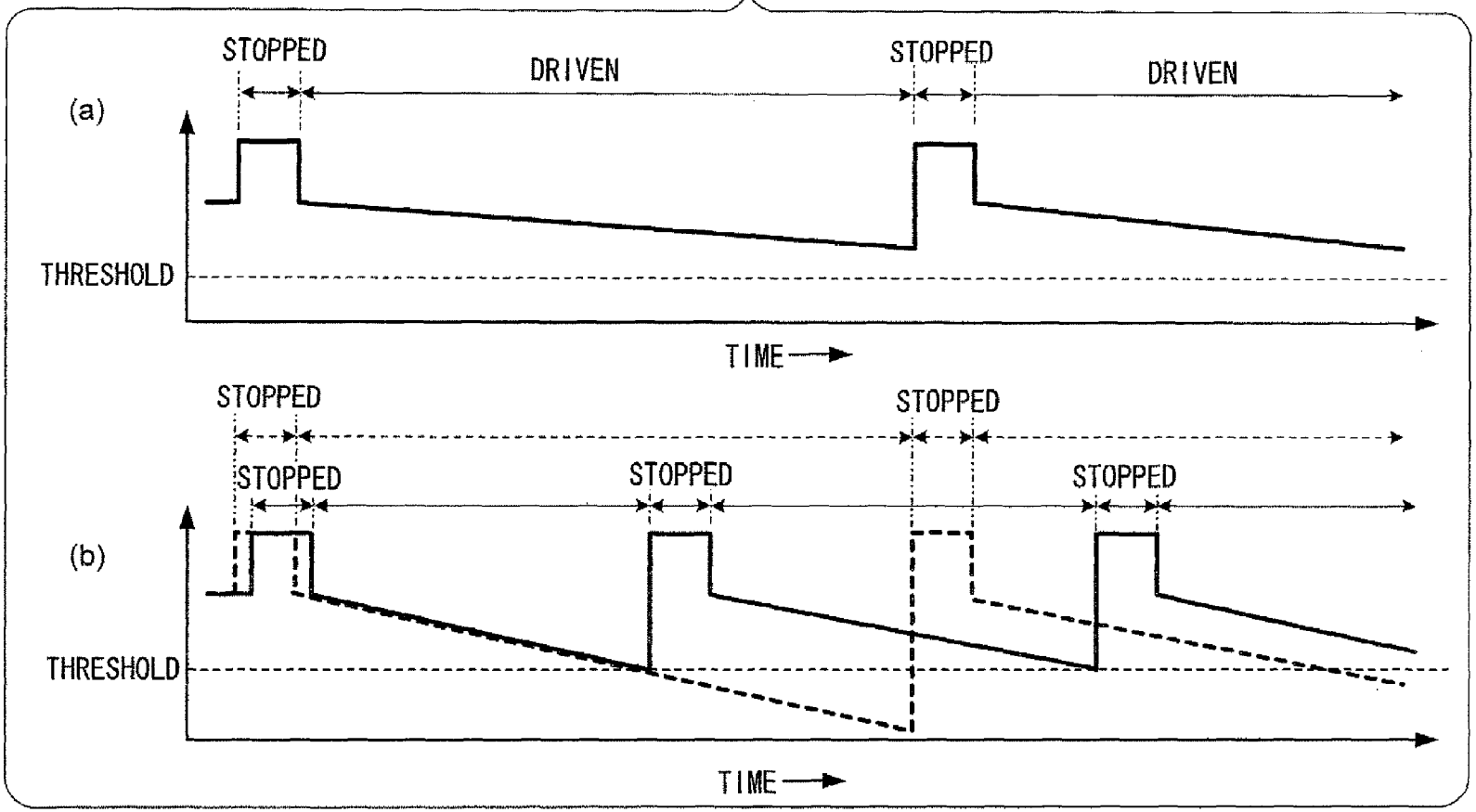
FIG. 8 is a graph illustrating an output and a threshold in both cases where an image is formed in a small image density and in a great image density.

Part (a) and (b) of FIG. 8 are graphs illustrating an output and a threshold in both cases where an image is formed in a small image density and in a great image density.

Part (a) of FIG. 8 illustrates an output and a threshold in a case where an image is formed in a small image density. In the case where an image is formed in a small image density, the amount of toner is small, and therefore, the toner remains at the tip of the blade 12_1 at a low speed. As a consequence, the blade 12_1 is slowly deformed. Accordingly, the resistance of the sensor 12_2 also is slowly decreased. Thus, the output does not become lower than the threshold even immediately before the photosensitive roll 11 is stopped upon completion of image formation, so that the photosensitive roll 11 is not temporarily stopped, unlike the above description.

In contrast, part (b) of FIG. 8 illustrates an output and a threshold in a case where an image is formed in a great image density. In the case where an image is formed in a great image density, the image includes the toner in the large amount, and therefore, the toner remains at the tip of the blade 12_1 at a high speed. As a consequence, the blade 12_1 is deformed in a short period of time in comparison with the image formation in the small image density. Accordingly, the resistance of the sensor 12_2 also is decreased in the short period of time. Thus, as indicated by a solid line of part (b) of FIG. 8, the output is lower than the threshold before the completion of the image formation. At this time, the photosensitive roll 11 is temporarily stopped.

As indicated by a dot line of part (b) of FIG. 8, in a state in which the output is lower than the threshold, if a situation that the photosensitive roll 11 is not stopped continues, a situation that the strain of the blade 12_1 is not restored also continues, thereby causing apprehension about burdens on both of the photosensitive roll 11 and the blade 12_1.

Figure 9:
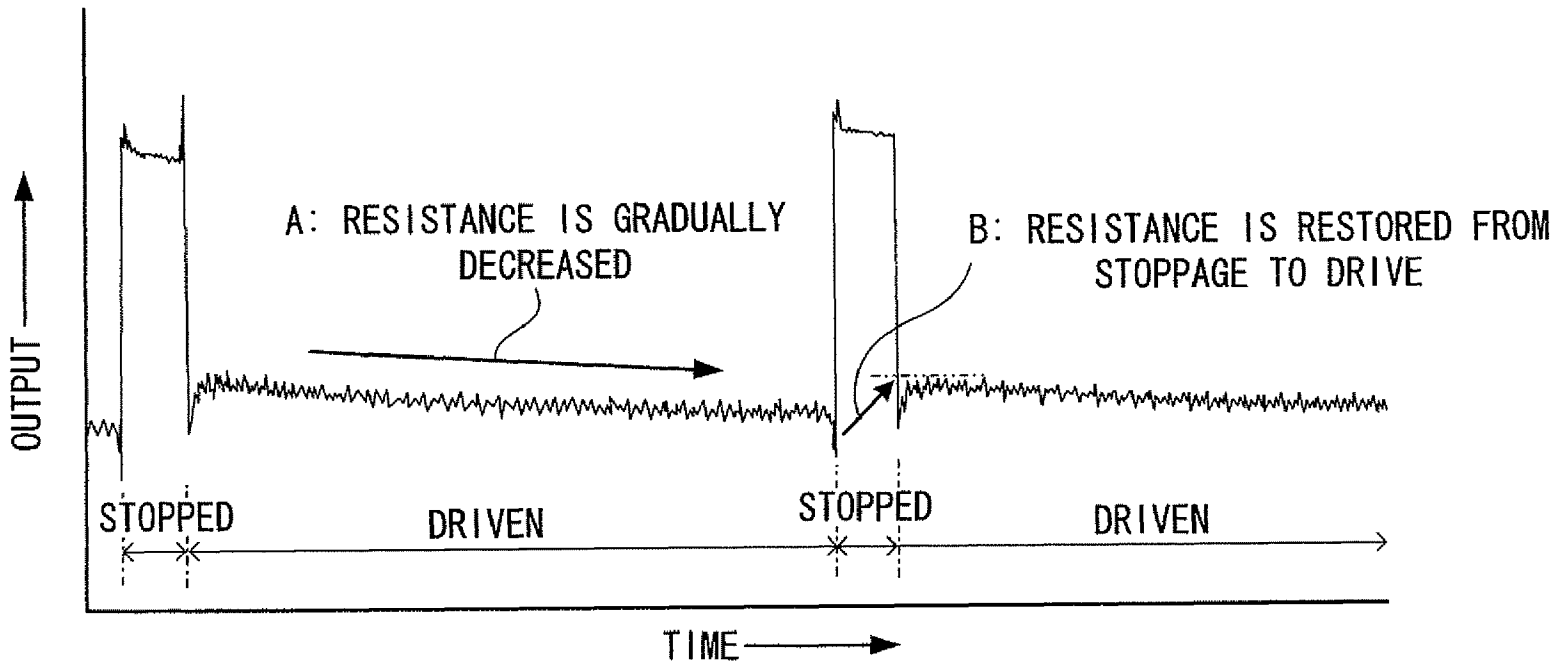
FIG. 9 is a graph illustrating a state in which the photosensitive roll is temporarily stopped, and then, a toner accumulated at the tip of the blade crumbles, and further, the photosensitive roll is restarted to be driven.

FIG. 9 is a graph illustrating a state in which the photosensitive roll is temporarily stopped, and then, the toner remaining at the tip of the blade crumbles, and further, the photosensitive roll is restarted to be driven.

During a period A illustrated in FIG. 9, as the toner remaining at the tip of the blade 12_1 is increased upon driving of the photosensitive roll 11, the blade 12_1 is more largely deformed, and therefore, the sensor 12_2 is decreased in resistance. The output is decreased accordingly. Thereafter, at the beginning of a period B, it is detected that the output is lower than the threshold, and thus, the photosensitive roll 11 is temporarily stopped. And then, the toner remaining at the tip of the blade 12_1 temporarily crumbles. In this manner, the force for catching up the tip of the blade 12_1 is released, so that the strain of the blade 12_1 is restored. Subsequently, the photosensitive roll 11 is restarted to be driven. And then, since the toner remaining at the tip of the blade 12_1 crumbles, the output is decreased from a value greater than the value immediately before the stoppage of the photosensitive roll 11, as indicated by an arrow in FIG. 9. In this manner, in the present exemplary embodiment, when it is detected that the output is lower than the threshold, the photosensitive roll 11 is temporarily stopped, and subsequently, the photosensitive roll 11 is restarted to be driven.

Although the sensor 12_2 is deposited onto only the obverse of the obverse and reverse of the blade 12_1 constituting the cleaning member 12 in the above-described exemplary embodiment, sensors may be deposited onto both of the obverse and reverse of a blade constituting a cleaning member, as described below.

Figure 10:
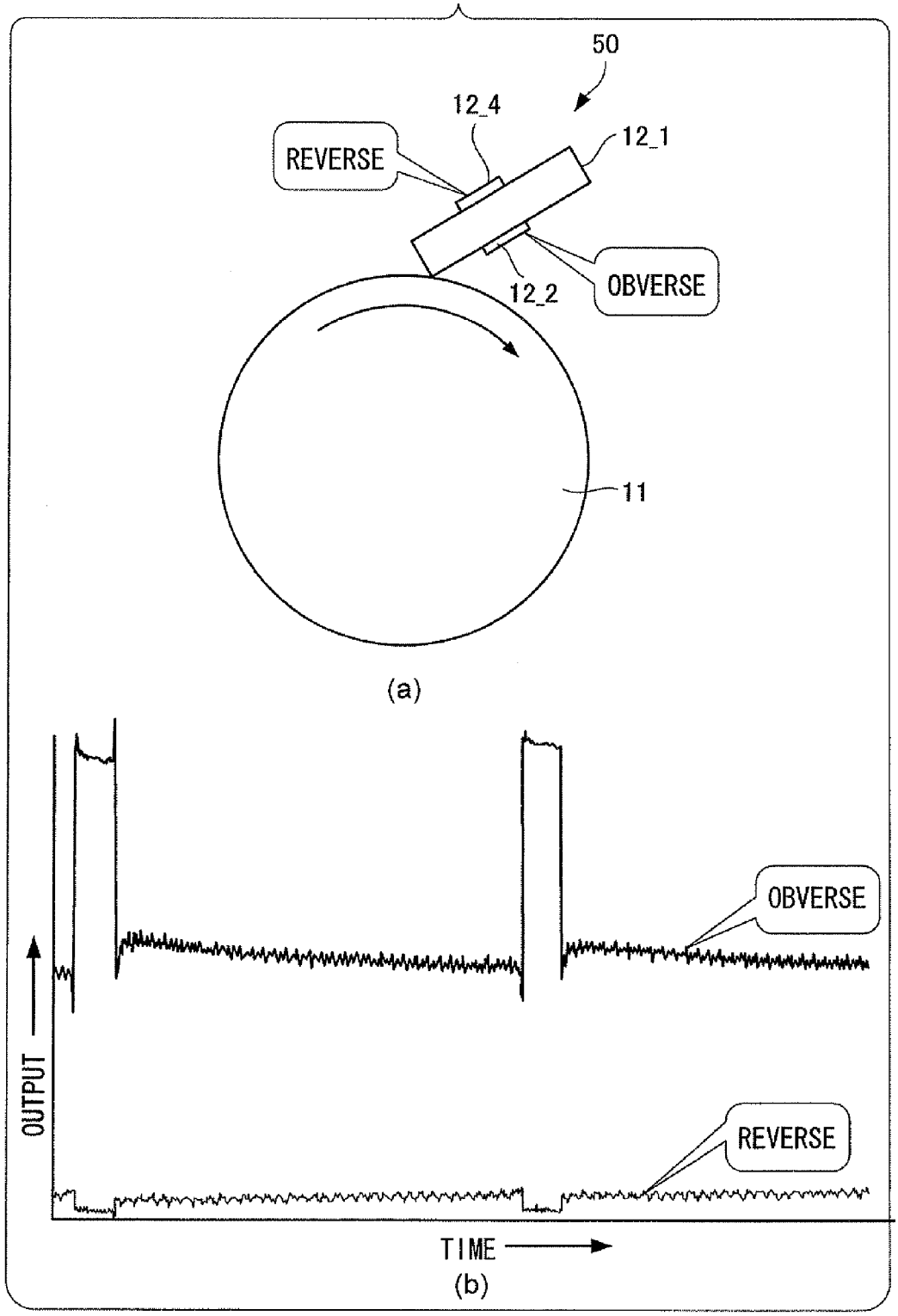
FIG. 10 illustrates a diagram of a cleaning member in a second exemplary embodiment of the present invention and a graph of an output based on a resistance that is varied according to strain of the cleaning member.

Part (a) and (b) of FIG. 10 are a diagram illustrating a cleaning member in a second exemplary embodiment of the present invention and a graph illustrating an output based on a resistance varying according to strain of the cleaning member.

In a cleaning member 50 illustrated in part (a) of FIG. 10, a sensor 12_4 having the same shape and characteristics as those of the sensor 12_2 is deposited also onto a reverse of the blade 12_1 in comparison with the cleaning member 12 illustrated in FIG. 1. Part (b) of FIG. 10 illustrates both of an output based on a resistance of the sensor 12_2 deposited onto the obverse of the blade 12_1 and an output based on a resistance of the sensor 12_4 deposited onto the reverse of the blade 12_1. Here, the output based on the resistance of the sensor 12_2 deposited onto the obverse of the blade 12_1, illustrated in an upper part of part (b) of FIG. 10, is identical to the output illustrated in FIG. 9.

In the case where the photosensitive roll 11 is stopped, the blade 12_1 is slightly deformed, and therefore, the respective resistances of the sensors 12_2 and 12_4 deposited onto the obverse and reverse of the blade 12_1 are approximate to each other. As a consequence, the outputs are approximate to each other in a manner corresponding to the resistances, respectively, as illustrated in upper and lower parts at the left end in part (b) of FIG. 10.

Here, when the photosensitive roll 11 is driven, the tip of the blade 12_1 is caught up, and then, the obverse of the blade 12_1 is deformed to be contracted. Therefore, the resistance of the sensor 12_2 deposited onto the obverse of the blade 12_1 is decreased by the deformation. As a consequence, the output becomes a value corresponding to the resistance decreased by the deformation, as illustrated in the upper part in part (b) of FIG. 10.

In contrast, although the reverse of the blade 12_1 is deformed to be expanded, this expansion is slight. Therefore, the resistance of the sensor 12_4 deposited onto the reverse of the blade 12_1 is increased by the slight expansion. As a consequence, the output becomes a value corresponding to the resistance increased by the expansion, as illustrated in the lower part in part (b) of FIG. 10.

A printer provided with the cleaning member 50 determines whether the tip of the blade 12_1 is caught up or the entire blade 12_1 is pressed. If the tip of the blade 12_1 is caught up, the resistance of the sensor 122 deposited onto the obverse of the blade 12_1 is decreased whereas the resistance of the sensor 12_4 deposited onto the reverse of the blade 12_1 is increased. Consequently, the difference between these resistances is large. In this case, it is determined that the tip of the blade 12_1 is caught up. If it is determined that the tip of the blade 12_1 is caught up, the photosensitive roll 11 is stopped, and thus, the strain of the blade 12_1 is restored.

In contrast, if the entire blade 12_1 is pressed, both of the resistances of the sensors 12_2 and 12_4 are decreased, and therefore, the difference between these resistances is small. In this case, it is determined that the entire blade 12_1 is pressed. If it is determined that the entire blade 12_1 is pressed, a trouble may possibly occur, and therefore, a display unit (not illustrated) displays an alarm.

In the above-described two exemplary embodiments, the sensor having the metallic film deposited thereonto is used on the blade constituting the cleaning member. Here, a sensor having a thin metal stuck thereonto via an adhesive agent may be used on the blade constituting the cleaning member in place of the sensors in the exemplary embodiments. Explanation will be made below on a specific example of a sensor stuck via an adhesive agent.

The length (i.e., the gage length) L and width (i.e., the gage width) W of the sensor and the material of the metallic film are identical to those of the sensor 12_2 illustrated in FIG. 2. Although the thickness (i.e., the film thickness) of the sensor is not particularly limited, a sensor having a thickness of several μm may be used in order to enhance productivity. In addition, a sensor having a thickness of 0.1 μm to 2.0 μm may be used to detect the strain of the blade with high accuracy. Adhesive agents are of a thermocurable type and a liquid type. A thermocurable adhesive agent is made of an epoxy resin, a phenol resin, a polyurethane resin, a silicon resin, a polyimide resin, or the like. A liquid adhesive agent is exemplified by a cyanoacrylate adhesive agent, an epoxy-based adhesive agent, or a phenol epoxy adhesive agent.

This sensor is poor in responsiveness by the adhesive agent in comparison with the sensor having the metallic film deposited thereonto. However, the adhesive agent is thinly used to such an extent as not to inhibit the deformation of the blade. The strain of the blade is restored by stopping the photosensitive roll based on the resistance of the sensor in the same manner as described above.

Here, a member to be cleaned according to the present invention is not an image carrier but may be a transfer belt or the like.

Moreover, although the image forming apparatus according to the present invention is exemplified by the printer in the present exemplary embodiments, the image forming apparatus according to the present invention may be a copying machine, a facsimile and the like as long as the image forming apparatus employs the electrophotographic system.

Additionally, the image forming apparatus according to the present invention is exemplified by the direct transfer type printer that directly transfers the development image formed on the photosensitive roll onto the fed recording sheet by the use of the transfer roll in the present exemplary embodiment. However, the image forming apparatus according to the present invention may be an image forming apparatus of an indirect transfer type that transfers a development image onto a recording sheet via a transfer belt.

In addition, although the image carrier according to the present invention is exemplified by the photosensitive roll employing the roll system in the present exemplary embodiment, the image carrier according to the present invention may be a photosensitive belt employing a circulating belt system.

Furthermore, although the cartridge according to the present invention is exemplified by the cartridge provided with the photosensitive roll and the cleaning member in the present exemplary embodiment, the cartridge according to the present invention may be provided with any one of the electric charger, the development device, and the transfer roll in addition to the photosensitive roll and the cleaning member.

Moreover, although the image forming unit according to the present invention is exemplified by the image forming unit provided with the electric charger, the exposing device, and the development device in the present exemplary embodiment, the image forming unit according to the present invention may directly form an image on an image carrier not through electric charging or development.

Additionally, although the transferring/fixing unit according to the present invention is exemplified by transferring the image by the transfer roll and then fixing it by the fixing unit in the present exemplary embodiment, the transferring/fixing unit according to the present invention may transfer and fix an image at the same time.

According to the exemplary embodiments, it is possible to provide a cleaning member capable of detecting deformation with good accuracy, a cartridge provided with the cleaning member, and an image forming apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling other skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier that has an image formed thereon and carries the image;

an image forming unit that forms the image on the image carrier;

a transferring/fixing unit that transfers the image formed on the image carrier onto a recording medium, and fixes the image onto the recording medium; and a cleaning member including a member body that is brought into contact with a surface of the image carrier, and a sensor that is fixed to a portion of the member body except a portion in contact with the image carrier and is made of a metallic thin film, wherein the image carrier has an image formed on a surface that is moved, and the member body removes adherents from the surface of the image carrier according to a movement of the surface of the image carrier, the image forming apparatus further comprising:

a drive unit that drives the image carrier to move the surface of the image carrier;

a strain gage circuit that is connected to the sensor to measure a strain of the cleaning member; and a drive controller that controls a drive of the image carrier by the drive unit based on a measurement result by the strain gage circuit.

2. The image forming apparatus according to claim 1, wherein the image forming unit forms an image on the image carrier with a development agent including a chemically produced toner, and the member body removes the chemically produced toner from the surface of the image carrier.

3. The image forming apparatus according to claim 2, wherein the chemically produced toner has a Geometrical Standard Deviation (GSD) of approximately 1.25 or less, as expressed by the following equation:

GSD={(approximately 16%–volume particle size of particle)/(approximately 84%–volume particle size of particle)}$^{0.5}$, where the approximately 16%–volume particle size of particle and the approximately 84%–volume particle size of particle represent, when a plurality of toner particles are arranged in increasing order of size, a volume particle size of approximately 16% th smallest toner particle of the plurality of toner particles and a volume particle size of approximately 84% th smallest toner particle of the plurality of toner particles, respectively.

4. The image forming apparatus according to claim 2, wherein the chemically produced toner has a sphericity of approximately 120 or less, as expressed by the following equation:

$$\text{Sphericity}=100\times\pi\times(\text{ML})^2/(4\times A)$$

(where ML designates a maximum length of a toner particle calculated by an image analyzer based on a two-dimensional projected image of a particle input from an optical microscope, and A denotes a projected area of the toner particle).

5. The image forming apparatus according to claim 1, wherein the image forming unit forms an image on the image carrier with a development agent including a toner incorporating crystalline polyester, and the member body removes the toner from the surface of the image carrier.

6. The image forming apparatus according to claim 1, wherein the surface of the image carrier is moved in a perpendicular direction, and the drive controller controls the drive of the image carrier in such a manner that velocity of the surface of the image carrier in the predetermined direction is decreased when the strain of the cleaning member measured by the strain gage is larger than a predetermined level of strain.

7. The image forming apparatus according to claim 6, wherein the drive controller controls the drive of the image carrier in such a manner that movement of the surface of the image carrier in the predetermined direction is temporarily stopped when the strain of the cleaning member measured by the strain gage is larger than a predetermined level of strain.

8. The image forming apparatus according to claim 1, wherein the sensor is composed of a first sensor mounted on an obverse of a plate forming an external form of the member body and a second sensor mounted on a reverse of the plate, and the drive controller determines whether the drive controller stops movement of the surface of the image carrier or the driver controller causes a predetermined display unit to display an alarm, depending on a difference between a measurement result obtained by the strain gage circuit from the first sensor and a measurement result obtained by the strain gage circuit from the second sensor.

* * * * *